US010051376B2

(12) United States Patent
Ohura

(10) Patent No.: US 10,051,376 B2
(45) Date of Patent: Aug. 14, 2018

(54) EDGE STRUCTURE OF DIAPHRAGM

(71) Applicant: SONY CORPORATION, Tokyo (JP)

(72) Inventor: Yoshikazu Ohura, Tokyo (JP)

(73) Assignee: SONY CORPORATION, Tokyo (JP)

( * ) Notice: Subject to any disclaimer, the term of this patent is extended or adjusted under 35 U.S.C. 154(b) by 25 days.

(21) Appl. No.: 15/038,100

(22) PCT Filed: Oct. 16, 2014

(86) PCT No.: PCT/JP2014/005245
§ 371 (c)(1),
(2) Date: May 20, 2016

(87) PCT Pub. No.: WO2015/097951
PCT Pub. Date: Jul. 2, 2015

(65) Prior Publication Data

US 2016/0316298 A1 Oct. 27, 2016

(30) Foreign Application Priority Data

Dec. 27, 2013 (JP) ..... 2013-272779

(51) Int. Cl.
*H04R 1/28* (2006.01)
*H04R 7/18* (2006.01)
*H04R 5/02* (2006.01)

(52) U.S. Cl.
CPC ..... *H04R 7/18* (2013.01); *H04R 1/2834* (2013.01); *H04R 5/02* (2013.01); *H04R 2307/207* (2013.01)

(58) Field of Classification Search
CPC ..... H04R 1/2834; H04R 5/02; H04R 7/18; H04R 2307/207; H04R 2231/001; H04R 7/16; H04R 31/003
See application file for complete search history.

(56) References Cited

U.S. PATENT DOCUMENTS 5,371,805 A * 12/1994 Saiki ..... H04R 7/06 181/171
6,757,404 B2 * 6/2004 Takewa ..... H04R 7/12 181/174

(Continued)

FOREIGN PATENT DOCUMENTS

JP 59-104693 A 7/1984
JP 05-292594 A 11/1993

(Continued)

OTHER PUBLICATIONS

Extended European Search Report of EP Patent Application No. 14874612.6, dated Jun. 9, 2017, 07 pages.

*Primary Examiner* — Matthew Eason
*Assistant Examiner* — Taunya McCarty
(74) *Attorney, Agent, or Firm* — Chip Law Group

(57) ABSTRACT

An edge surrounding a diaphragm has a recessed portion having a recess in one direction of vibration of the diaphragm, and a projecting portion having a projection in the one direction. At least part of the edge continuously has a first changing shape and a second changing shape. The first changing shape has a shape in which a cross-sectional shape of the recessed portion has a length gradually reduced, a cross-sectional shape of the projecting portion has a length gradually increased, and the recessed portion and the projecting portion change from one to the other, and the second changing shape has a shape in which a cross-sectional shape of the recessed portion has a length gradually increased, a cross-sectional shape of the projecting portion has a length gradually reduced, and the projecting portion and the recessed portion change from one to the other.

11 Claims, 17 Drawing Sheets

(56) References Cited

U.S. PATENT DOCUMENTS

| | | | | |
|---|---|---|---|---|
| 6,895,097 | B2 * | 5/2005 | Furuyama | H04R 7/20 181/171 |
| 6,957,714 | B2 * | 10/2005 | Takahashi | H04R 7/20 181/171 |
| 7,568,552 | B2 * | 8/2009 | Litovsky | H04R 7/20 181/171 |
| 2007/0201712 | A1 * | 8/2007 | Saiki | H04R 1/2834 381/186 |
| 2007/0223772 | A1 * | 9/2007 | Kaiwa | H04R 7/18 381/398 |
| 2009/0139794 | A1 | 6/2009 | Silver | |
| 2010/0310110 | A1 * | 12/2010 | Chen | H04R 7/122 381/396 |
| 2011/0194724 | A1 * | 8/2011 | Watanabe | H04R 7/20 381/398 |
| 2011/0243361 | A1 * | 10/2011 | Koike | H04R 7/06 381/386 |

FOREIGN PATENT DOCUMENTS

| | | | |
|---|---|---|---|
| JP | 10-257590 | A | 9/1998 |
| JP | 2004-048494 | A | 2/2004 |
| JP | 2008-160363 | A | 7/2008 |
| JP | 1827948 | A | 11/2011 |
| WO | 2006/030760 | A | 3/2006 |
| WO | 2011/007151 | A2 | 1/2011 |

* cited by examiner

201

A

B

C

EDGE STRUCTURE OF DIAPHRAGM

CROSS REFERENCE TO RELATED APPLICATIONS

This application is a U.S. National Phase of International Patent Application No. PCT/JP2014/005245 filed on Oct. 16, 2014, which claims priority benefit of Japanese Patent Application No. JP 2013-272779 filed in the Japan Patent Office on Dec. 27, 2013. Each of the above-referenced applications is hereby incorporated herein by reference in its entirety.

TECHNICAL FIELD

The present disclosure relates to an edge structure of a diaphragm.

BACKGROUND ART

A loudspeaker system is known which includes a passive radiator in addition to a speaker unit in order to enhance a bass sound. A passive radiator structure having a weight is described in the following Patent Document 1.

CITATION LIST

Patent Document

Patent Document 1: Japanese Patent Application Laid-Open No. 4827948.

SUMMARY OF THE INVENTION

Problems to be Solved by the Invention

In the passive radiator, the weight needs to be set to have a large weight to achieve sufficient bass reproduction in a small volume. However, as a result, unnecessary vibration called rolling occurs, and unfortunately, an abnormal sound is likely to be generated.

Thus, an object of the present disclosure is to provide an edge structure of a diaphragm which inhibits unnecessary vibration to prevent abnormal sound caused by rolling.

Solutions to Problems

In order to solve the above problems, the present disclosure provides for example an edge structure of a diaphragm.

In the edge structure of a diaphragm, an edge surrounding a diaphragm has a recessed portion having a recess in one direction of vibration of the diaphragm, and a projecting portion having a projection in the one direction, at least part of the edge continuously has a first changing shape and a second changing shape, the first changing shape has a shape in which a cross-sectional shape of the recessed portion has a length gradually reduced, a cross-sectional shape of the projecting portion has a length gradually increased, and the recessed portion and the projecting portion change from one to the other, and the second changing shape has a shape in which a cross-sectional shape of the recessed portion has a length gradually increased, a cross-sectional shape of the projecting portion has a length gradually reduced, and the projecting portion and the recessed portion change from one to the other.

Effects of the Invention

According to at least one embodiment, the unnecessary vibration of the passive radiator can be inhibited, and the abnormal sound caused by the rolling can be prevented. Note that the present disclosure is not necessarily limited to the effects described here, and may have any effect described in the present disclosure. Further, effects are exemplified in the following description, but are not intended to limit the content of the present disclosure.

MODE FOR CARRYING OUT THE INVENTION

Hereinafter, a plurality of embodiments according to the present disclosure will be described with reference to the drawings. The description will be given in the following order.

<1. First Embodiment>
<2. Second Embodiment>
<3. Modifications>

Embodiments or the like described below represent preferred specific examples of the present disclosure, but the content of the present disclosure is not limited to these embodiments or the like.

Note that, in the below description, expressions defining directions, such as front/back, right/left, surface/back surface, and the like are used for convenience of description, but the content of the present disclosure is not limited to these directions.

1. First Embodiment

[External Appearance of Loudspeaker System]

Figure 1:
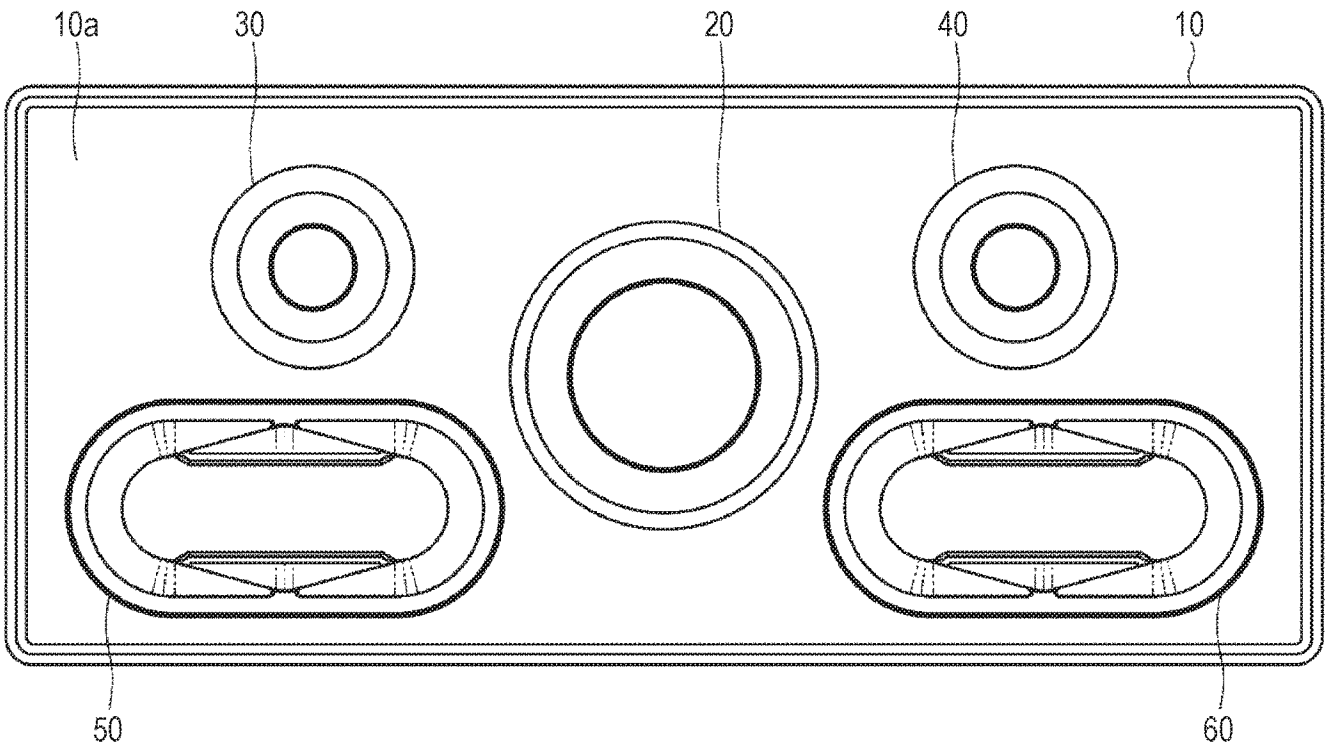
FIG. 1 is a front view illustrating an exemplary configuration of a loudspeaker system.
Figure 2:
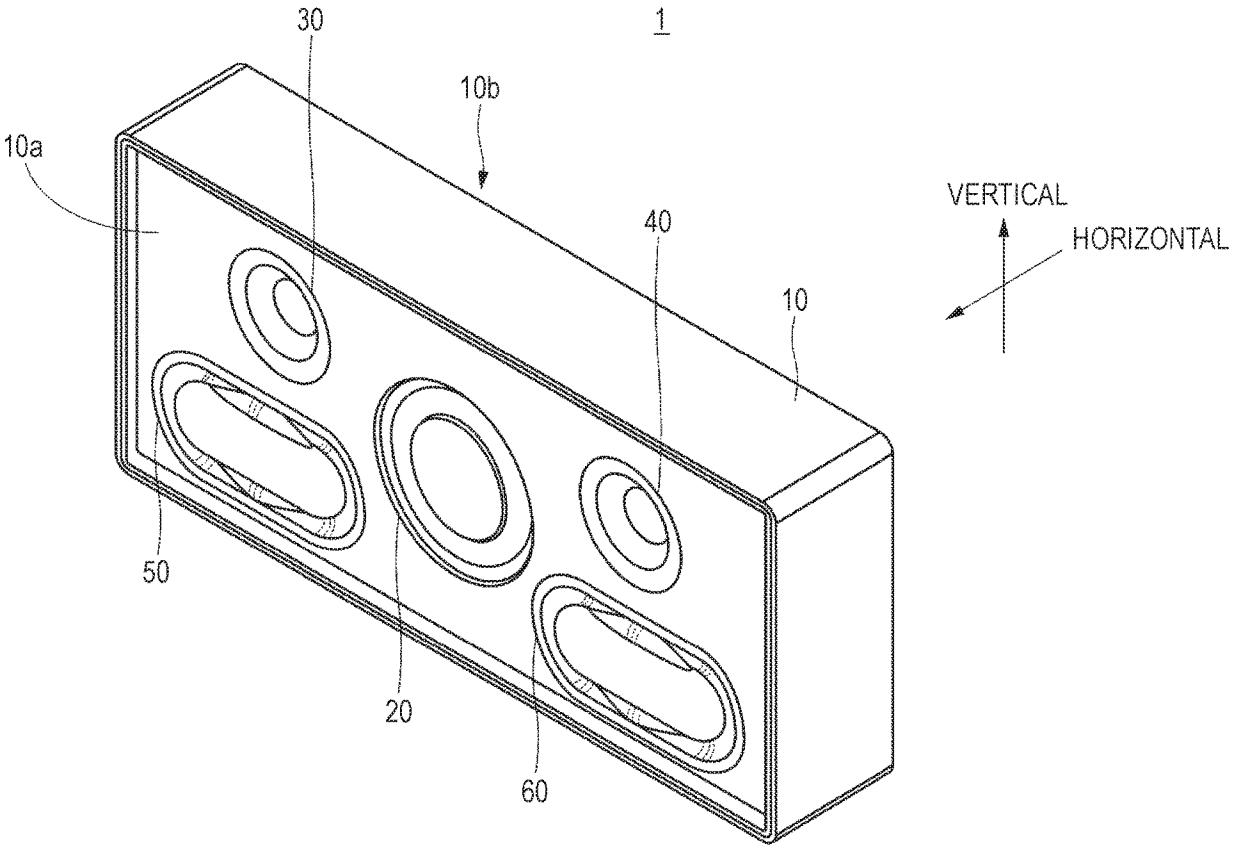
FIG. 2 is a perspective view illustrating an exemplary configuration of the loudspeaker system.

FIG. 1 is a front view illustrating exemplary appearance of a loudspeaker system, and FIG. 2 is a perspective view illustrating exemplary appearance of the loudspeaker system. A loudspeaker system 1 has a cabinet 10 having a substantially parallelepiped shape. The cabinet 10 has a front surface 10*a* facing a user, and a back surface 10*b* positioned on the opposite side of the front surface 10*a*.

The front surface 10*a* of the cabinet 10 is provided with, for example, a speaker unit (also referred to as sub-woofer) 20 positioned at substantially the center and reproducing low-frequency sounds. Both ends of the speaker unit 20 are provided with a speaker unit 30 and a speaker unit 40 positioned at upper portions thereof and reproducing middle- and high-frequency sounds, respectively. The speaker unit 30 and the speaker unit 40 have back sides each sealed by, for example, a predetermined sealing structure, in the cabinet 10.

Below the speaker unit 30, a passive radiator 50 is provided, and below the speaker unit 40, a passive radiator 60 is provided. As described above, in the present embodiment, the loudspeaker system 1 constitutes a reproduction system of 2.1 channel as a whole. The present disclosure is not limited to a 2.1 channel loudspeaker system as a matter of course, and can be also applied to another reproduction system. Note that each of the speaker units or each of the passive radiators may be changed appropriately in position. Further, a speaker net or the like may be mounted on a front surface side of the cabinet 10.

Note that an up-and-down direction of the loudspeaker system 1 (direction substantially parallel with the front surface 10*a*) is appropriately referred to as a vertical direction, and a front-and-back direction of the loudspeaker system 1 (direction substantially perpendicular to the front surface 10*a*) is appropriately referred to as a horizontal direction.

Hereinafter, operation of the loudspeaker system 1 will be roughly described. Supply of an audio signal to each speaker unit causes vibration of a diaphragm of each speaker unit, and generation of sound. Further, sound pressure generated by vibration of the speaker unit 20 is radiated in the cabinet 10, the radiated sound pressure vibrates the passive radiator 50 and the passive radiator 60 in a horizontal direction, and thus, the low-frequency sound is generated. The passive radiator 50 and the passive radiator 60 repeat vibration in a positive direction (in a direction opposite to an inside of the cabinet 10), and vibration in a negative direction (toward the inside of the cabinet 10).

Sounds generated by the speaker units and the passive radiators are reproduced for the user. The sounds are preferably audible by human ears, including human voice or music.

[Configuration of General Passive Radiator]

Hereinafter, for easy understanding of the present disclosure, a configuration of a general passive radiator will be described. The passive radiator has a main body portion of the passive radiator.

Figure 3:
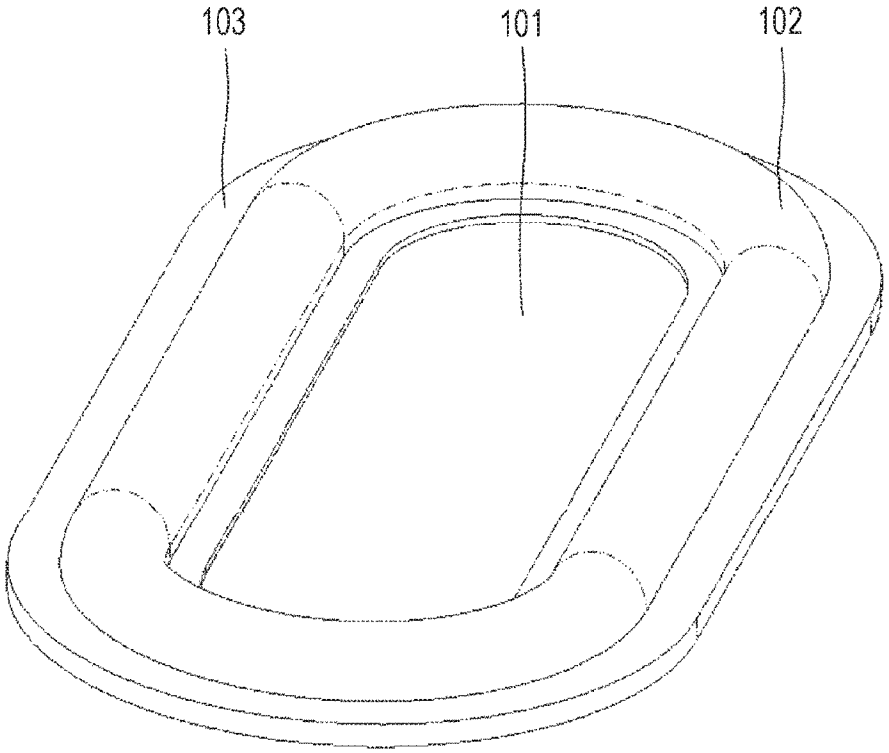
FIG. 3 PRIOR ART
FIG. 3 is a perspective view illustrating a configuration of a general passive radiator.

FIG. 3 is a perspective view illustrating the main body portion of the general passive radiator. Note that, for easy understanding of a shape, an imaginary line expressed by a two-dot chain line is illustrated in FIG. 3. The same is true on other drawings.

The main body portion 100 has, for example, substantially a track shape as a whole, and has a configuration including a flat portion 101 formed at substantially the center, an edge 102 formed around the flat portion 101 into substantially a track shape, and an outer peripheral edge portion 103 formed around the edge 102 into substantially a track shape. Note that the track shape represents a shape obtained by substituting semicircular shapes for opposite two sides of a rectangular shape, and looking like an athletic track field.

On a back surface of the flat portion 101 (inside of the cabinet), a diaphragm, not illustrated, is mounted. On a back surface of the diaphragm, a weight is mounted for making a mass of a drive system including the diaphragm constant. The outer peripheral edge portion 103 is mounted to a frame, not illustrated, and thus, the passive radiator is mounted to the cabinet through the frame.

Figure 4:
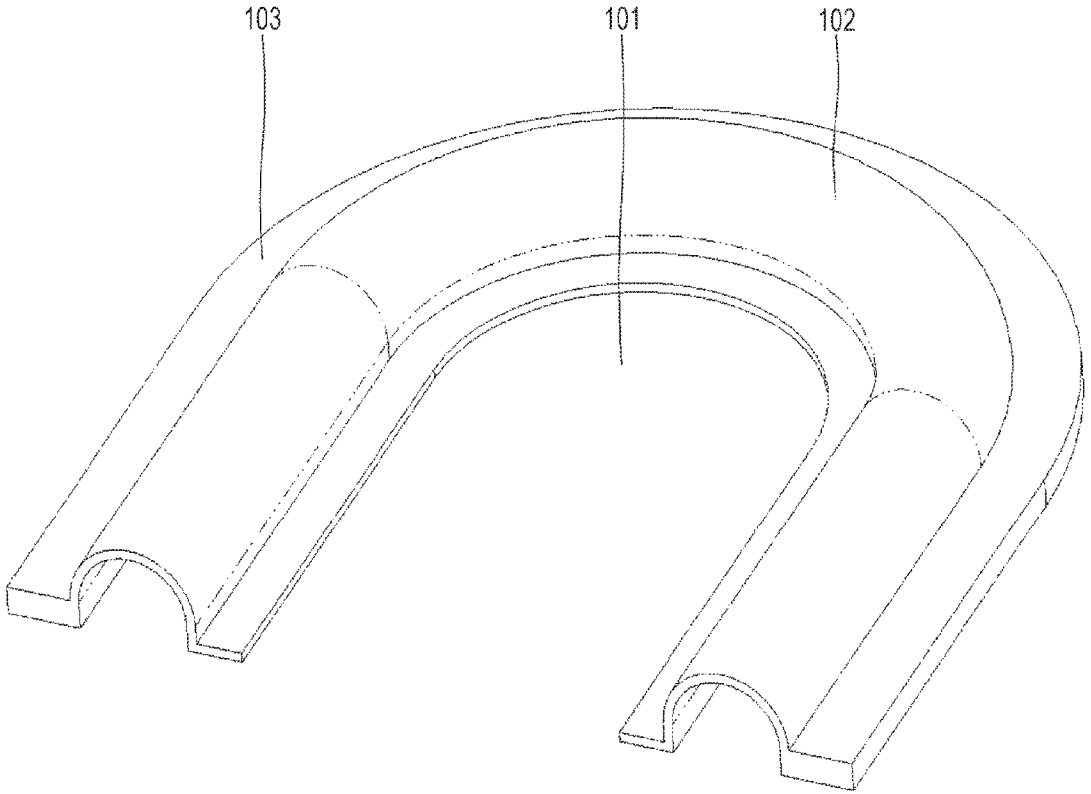
FIG. 4 PRIOR ART
FIG. 4 is a perspective view illustrating a cross-sectional structure of the general passive radiator.

FIG. 4 is a cross-sectional view of the main body portion 100 cut away in the vicinity of the center in a longitudinal direction. As illustrated in FIG. 4, the edge 102 has a substantially semicircular cross-sectional shape. That is, in the general passive radiator, the edge has a roll shape projecting in one direction (e.g., opposite side to the inside of the cabinet).

As described above, the diaphragm may not be vibrated in a horizontal direction to cause rolling being vibration in an oblique direction relative to the horizontal direction, and thus, abnormal sound is likely to be generated. In addition, particularly, input resistance may be reduced. Moreover, vibration or rotation in an oblique direction or the like may cause contact between the passive radiator and a surrounding structure, and thus, generation of the abnormal sound or damage of the structure or the like is likely to occur. The present disclosure has been made in view of such problems, and an example of the passive radiator according to the present disclosure will be described below.

[Configuration of Passive Radiator According to First Embodiment]

Figure 5:
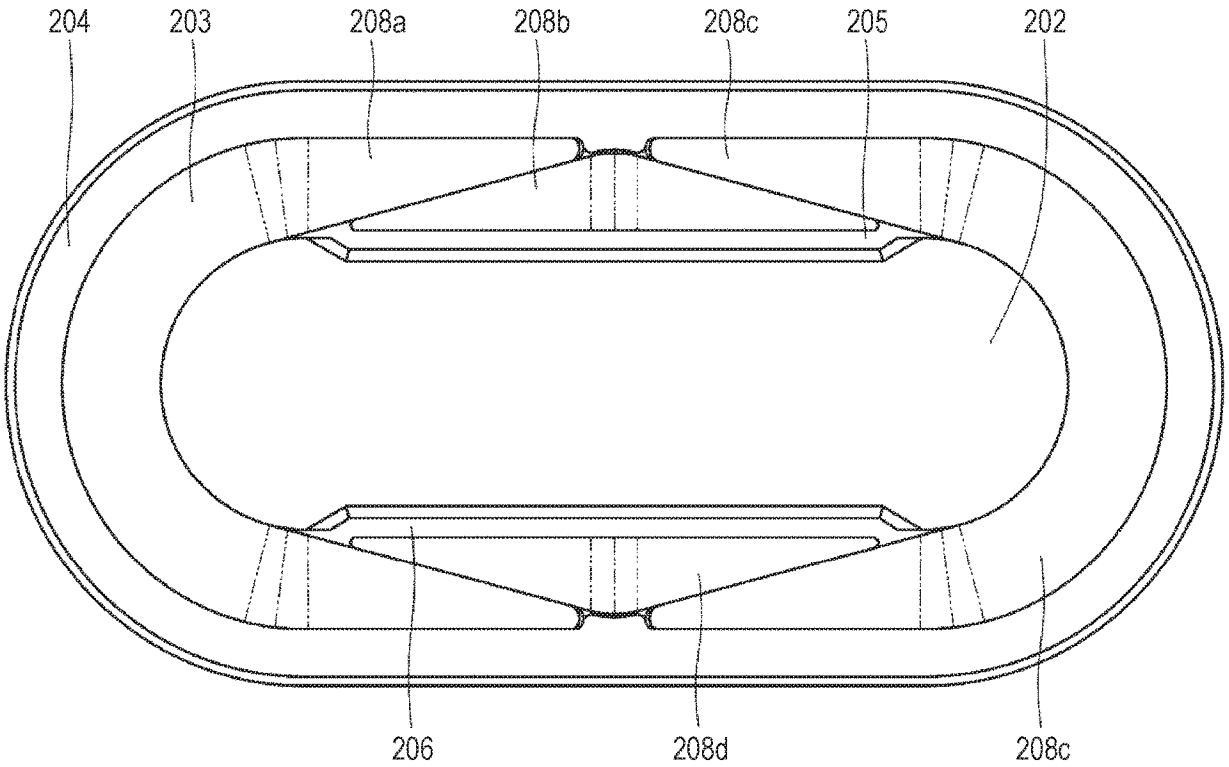
FIG. 5 is a diagram illustrating an exemplary configuration of a main body portion of a passive radiator according to a first embodiment.

FIG. 5 is a front view of an exemplary configuration of a main body portion of the passive radiator according to a first embodiment. Note that the passive radiator 50 is described here, but the same is true on a configuration of the passive radiator 60. The main body portion 201 includes vulcanized rubber or unvulcanized rubber of isobutene-isoprene rubber (IIR), acrylonitrile-butadiene rubber (NBR), or the like. The main body portion 201 has an outer peripheral edge in which an outer peripheral edge portion 204 is formed to have, for example, side portions opposed in a longitudinal direction, and have arcuate both ends. At substantially the center of the main body portion 201, a flat portion 202 is formed. The flat portion 202 has both ends having, for example, an arcuate shape, and the flat portion 202 has a major surface (main surface) positioned on substantially the same plane on which a main surface of the outer peripheral edge portion 204 is positioned.

Between the flat portion 202 and the outer peripheral edge portion 204, an edge 203 is formed having side portions (first side portion and second side portion) opposed in a longitudinal direction, the edge 203 having substantially a track shape. The edge 203 surrounding the diaphragm described later has a roll shape projecting in a negative direction (back side toward the drawing) of vibration of the passive radiator 50, and a roll shape projecting in a positive direction (front side toward the drawing) of vibration of the passive radiator 50. In the following description, the roll shape projecting in the negative direction is appropriately referred to as recessed roll portion, and the roll shape projecting in the positive direction is appropriately referred to as projecting roll portion. Note that the roll shape means a shape having, for example, a semicircular or substantially semicircular cross-section.

For example, recessed roll portions are continuously formed from arcuate portions at both ends of the edge 203 to parts of longitudinal directions. Thus, the edge 203 has, near both ends thereof, a shape recessed relative to the main surface of the flat portion 202 and the main surface of the outer peripheral edge portion 204, and a side surface is thereby generated around the main surface of the flat portion 202. Near the left side of the edge 203 in the drawing, for example, a recessed roll portion 208*a* is formed, and near the right side of the edge 203 in the drawing, for example, a recessed roll portion 208*c* is formed.

In at least one longitudinal direction of the edge 203, a changing shape is formed in which the roll shapes are changed from one to the other. For example, in one longitudinal direction of the edge 203, the roll shapes are changed gradually from the recessed roll portion 208*a* to a projecting roll portion 208*b*. In other words, projection of the projecting roll portion 208*b* is gradually increased, and in the vicinity of the center in the longitudinal direction of the edge 203, the projecting roll portion 208*b* has a maximum projection.

From the vicinity of the center to an end portion in the longitudinal direction of the center edge 203, the roll shapes are gradually changed from the projecting roll portion 208*b* to the recessed roll portion 208*c*. In other words, projection of the projecting roll portion 208*b* is gradually increased, and near an end in the longitudinal direction of the edge 203, the projection of the projecting roll portion 208*b* is reduced to 0 or substantially zero.

Note that in one direction (e.g., clockwise) of the edge 203, the changing shape in which the roll shapes are changed from the recessed roll portion to the projecting roll portion is referred to as a first changing shape, and the changing shape in which the roll shapes are changed from the projecting roll portion to the recessed roll portion is referred to as a second changing shape. In the present embodiment, for example, the first changing shape and the second changing shape are continuously formed. Thus, a shape can be obtained in which part of the edge 203 (e.g., in the vicinity of the center in the longitudinal direction) is protruded.

In the present embodiment, in the other longitudinal direction of the edge 203, a first changing shape and a second changing shape are formed at positions opposed to positions at which the above-mentioned first changing shape and the second changing shape are respectively formed. In the other longitudinal direction of the edge 203, the roll shapes are changed gradually from the recessed roll portion 208*c* to a projecting roll portion 208*d*. In other words, projection of the projecting roll portion 208*d* is gradually increased, and in the vicinity of the center in the other longitudinal direction of the edge 203, the projecting roll portion 208*d* has a maximum projection.

From the vicinity of the center to an end portion in the longitudinal direction of the center edge 203, the roll shapes are gradually changed from the projecting roll portion 208*d* to the recessed roll portion 208*a*. In other words, projection of a projecting roll portion 208*d* is gradually increased, and near an end in the longitudinal direction of the edge 203, the projection of the projecting roll portion 208*d* is reduced to 0 or substantially zero.

Between the projecting roll portion 208*b* and a side surface of the flat portion 202, and between the projecting roll portion 208*d* and a side surface of the flat portion 202, a groove portion 205 and a groove portion 206 are formed, respectively.

Figure 6:
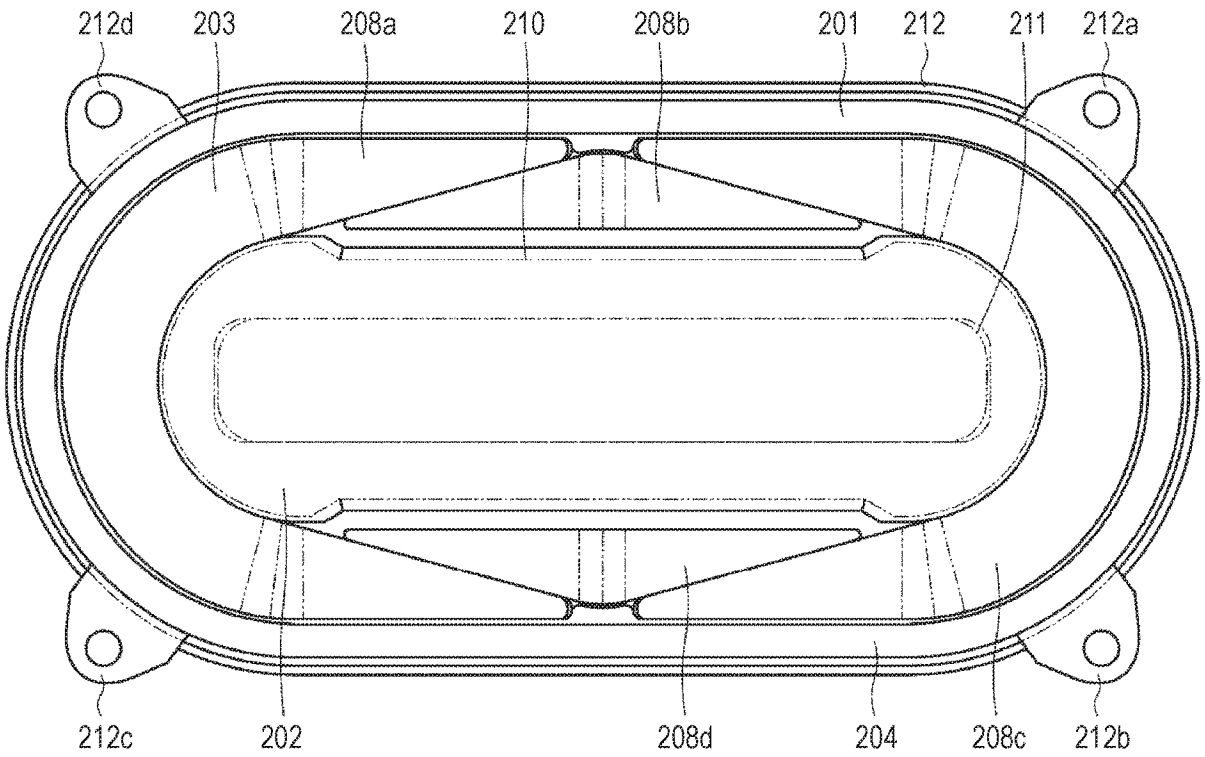
FIG. 6 is a diagram illustrating an exemplary configuration of the passive radiator according to the first embodiment.

FIG. 6 is a front view of an exemplary configuration of the passive radiator according to the first embodiment. On a back surface of the flat portion 202, the diaphragm 210 having substantially the same shape as that of the flat portion 202 is attached with an adhesive or the like. In the following description, the flat portion 202 and the diaphragm 210 attached on the back surface of the flat portion 202 are sometimes simply and collectively referred to as the diaphragm. On a back surface of the diaphragm 210, a weight 211 is attached. The weight 211 is formed into for example a plate shape, and includes plastic, a metal, or the like. Note that, in FIG. 6, the diaphragm 210 and the weight 211 are represented by a two-dot chain line.

The outer peripheral edge portion 204 has a back surface on which a frame 212 is attached with an adhesive or the like. The frame 212 includes for example a metal, and has mounting mechanisms 212*a*, 212*b*, 212*c*, and 212*d* at four corners around the frame. In each of the mounting mechanisms, a hole portion is formed, and a screw or the like is inserted into the hole portion to mount the passive radiator 50 to the cabinet 10.

Figure 7:
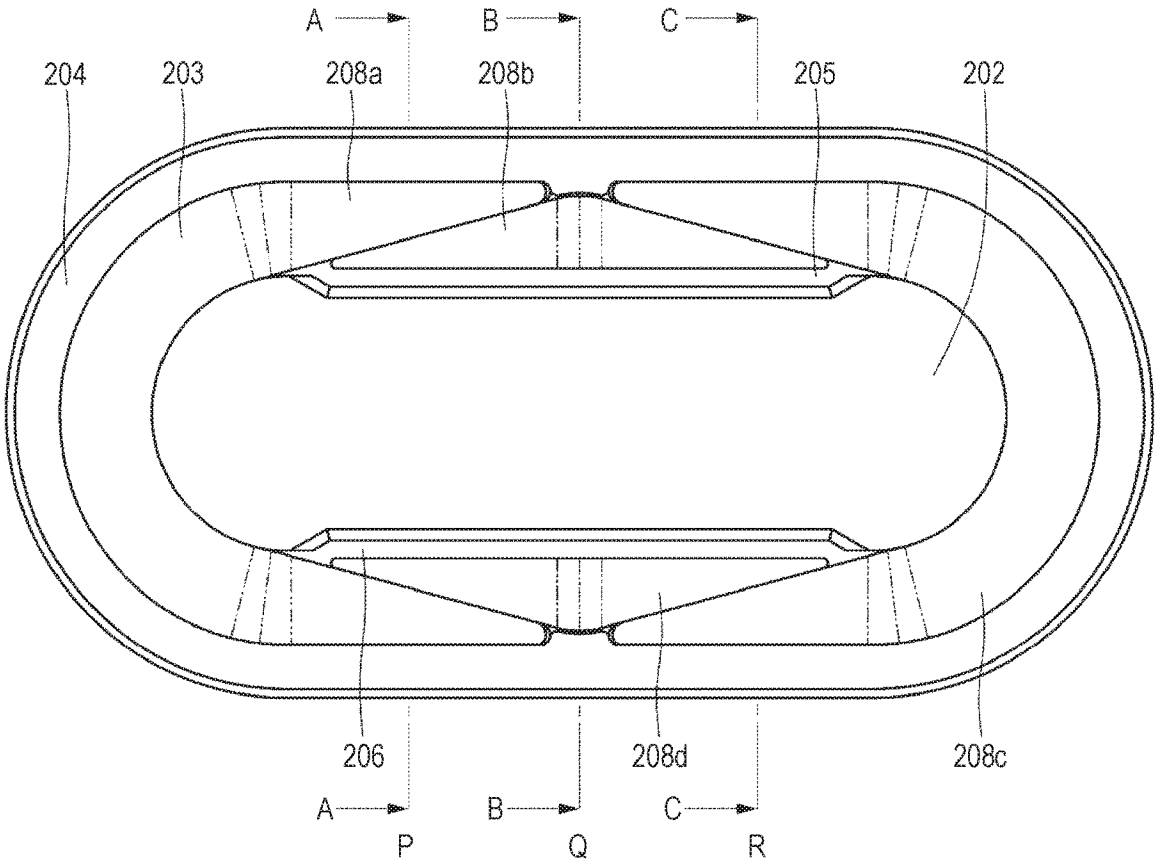
FIG. 7 is a diagram illustrating cut positions for the main body portion of the passive radiator according to the first embodiment.

An exemplary edge structure of the passive radiator 50 will be described in detail with reference to the drawings of FIGS. 7 to 13. FIG. 7 is a diagram illustrating an example of cut positions for the main body portion 201 of the passive radiator 50. In the edge 203, a cut position P is set to pass a position in which the roll shapes is changed from the recessed roll portion 208*a* to the projecting roll portion 208*b*, and a position in which the roll shapes are changed from the projecting roll portion 208*d* to the recessed roll portion 208*a*. The cut position P is represented by a cutting plane line A-A.

In the edge 203, a cut position Q is set to pass through a position at which the projecting roll portion 208*b* has the maximum projection (appropriately referred to as top portion), and a top portion of the projecting roll portion 208*b*. The cut position Q is represented by a cutting plane line B-B.

In the edge 203, a cut position R is set to pass through a position in which the roll shapes are changed from the projecting roll portion 208*b* to the recessed roll portion 208*c*, and a position in which the roll shapes are changed from the recessed roll portion 208*c* to the projecting roll portion 208*d*. The cut position R is represented by a cutting plane line C-C.

Figure 8:
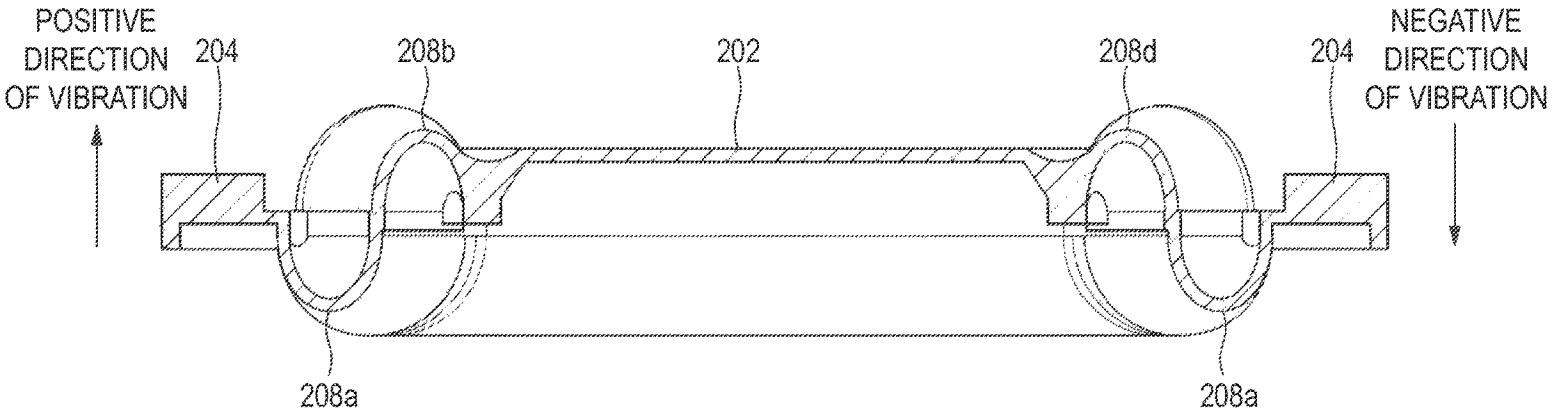
FIG. 8 is a cross-sectional view illustrating a cross-sectional shape taken along a line A-A.
Figure 9:
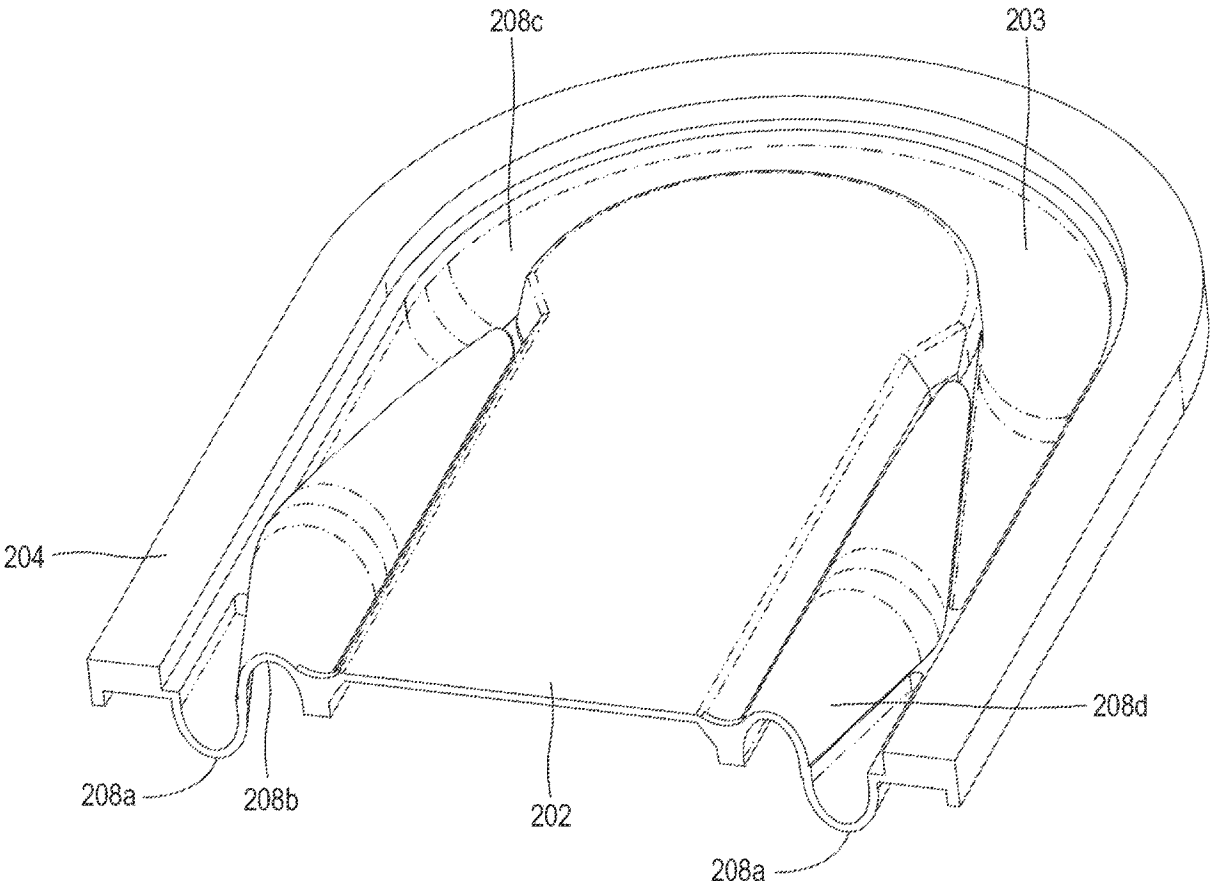
FIG. 9 is a perspective view illustrating a cross-sectional shape taken along the line A-A.
Figure 10:
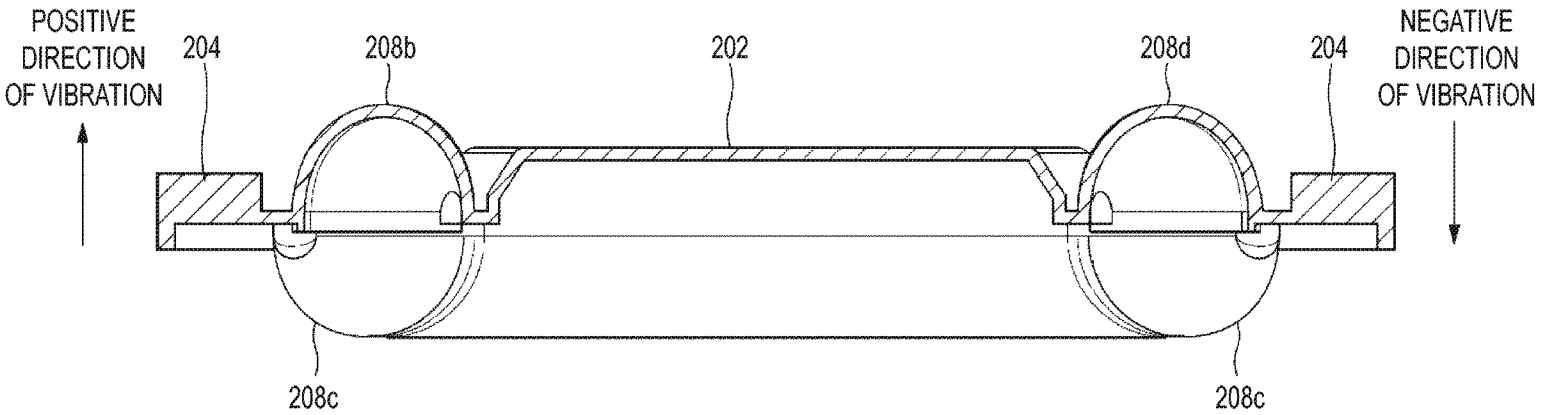
FIG. 10 is a cross-sectional view illustrating a cross-sectional shape taken along a line B-B.
Figure 11:
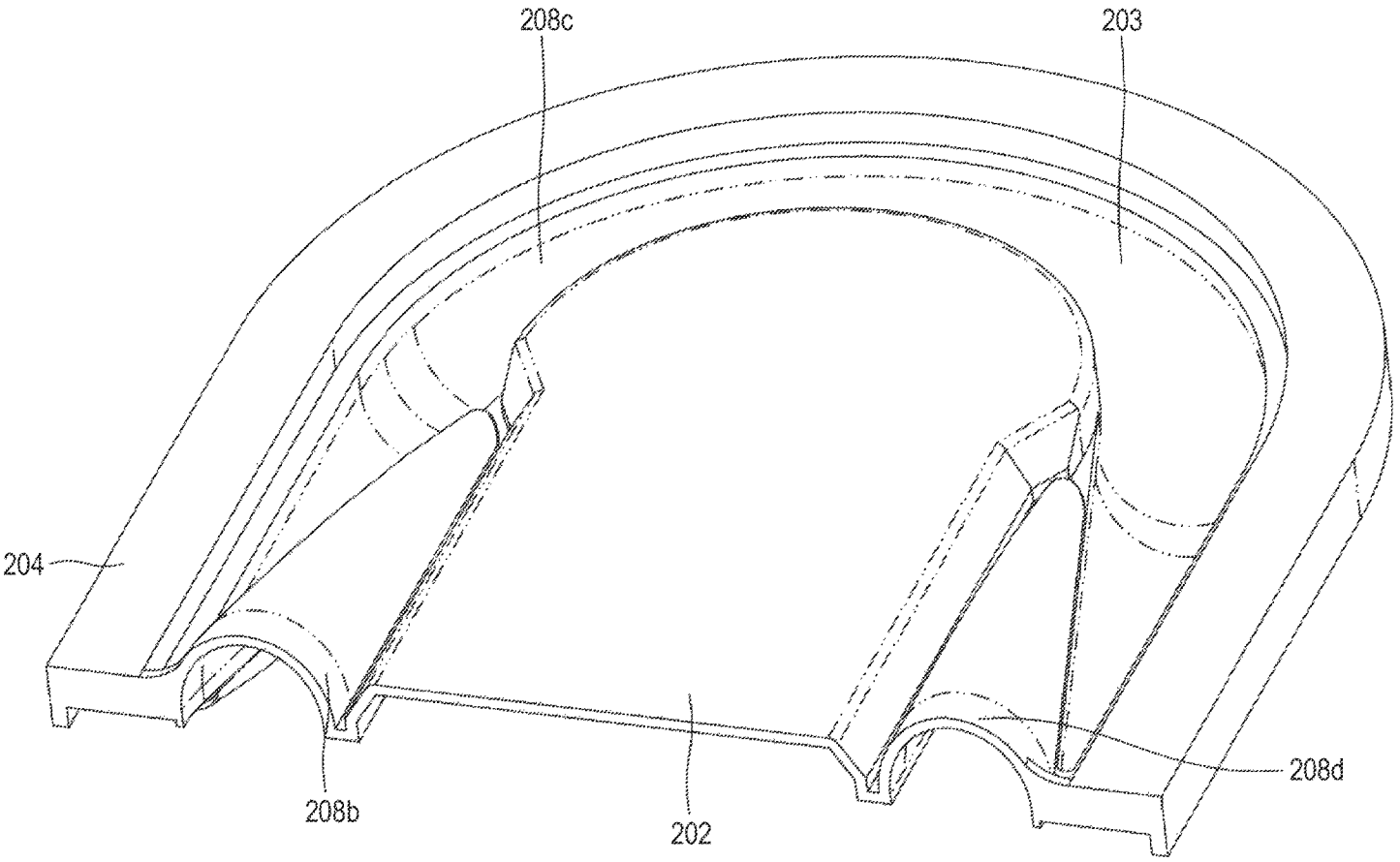
FIG. 11 is a perspective view illustrating a cross-sectional shape taken along the line B-B.
Figure 12:
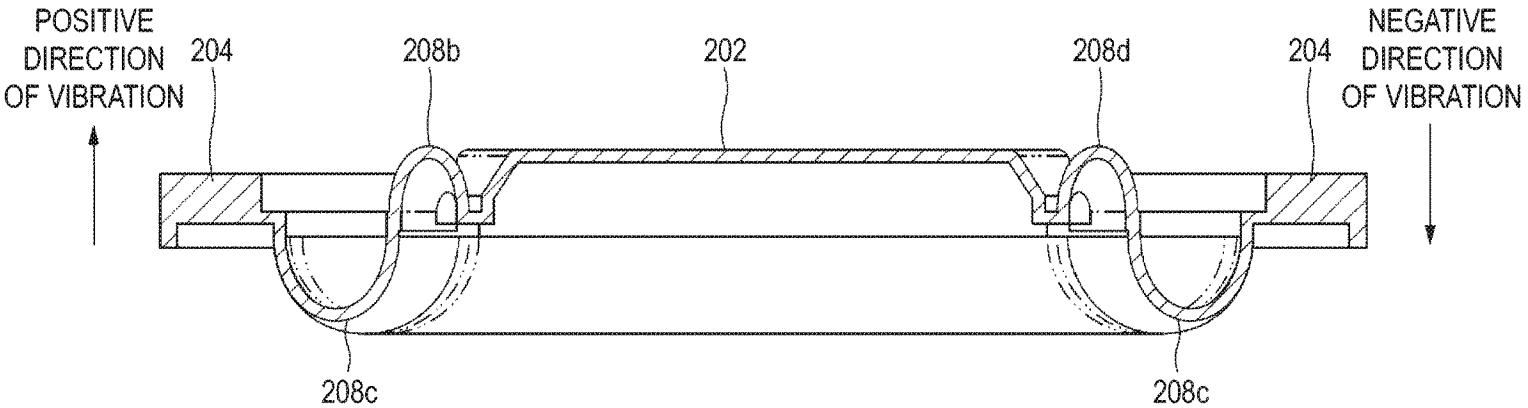
FIG. 12 is a cross-sectional view illustrating a cross-sectional shape taken along a line C-C.
Figure 13:
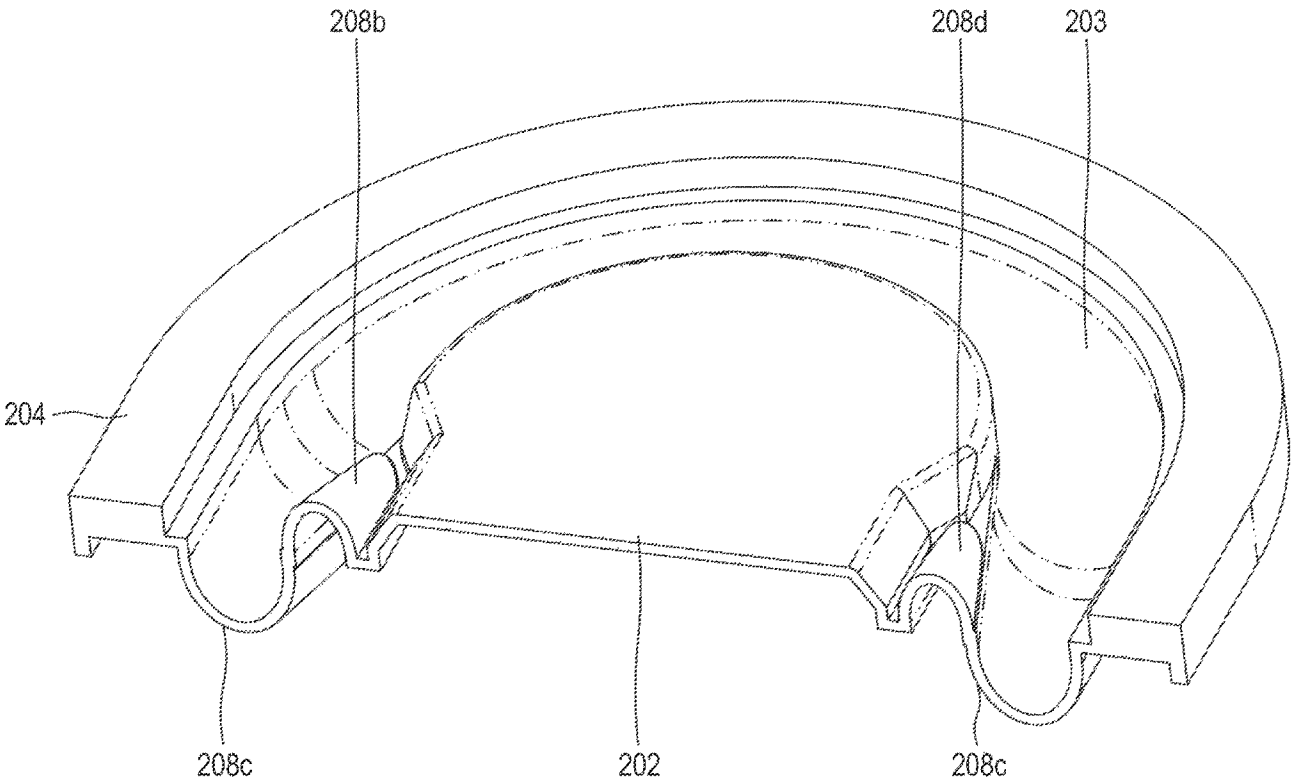
FIG. 13 is a perspective view illustrating a cross-sectional shape taken along the line C-C.

FIG. 8 is a cross-sectional view illustrating a cross-sectional structure taken along the line A-A, and FIG. 9 is a perspective view illustrating a cross-sectional structure taken along the line A-A. FIG. 10 is a cross-sectional view illustrating a cross-sectional structure taken along the line B-B, and FIG. 11 is a perspective view illustrating a cross-sectional structure taken along the line B-B. FIG. 12 is a cross-sectional view illustrating a cross-sectional structure taken along the line C-C, and FIG. 13 is a perspective view illustrating a cross-sectional structure taken along the line C-C.

Note that, in the following description, a length from one end (starting point) to the other end (terminal point) in a cross-section of the recessed roll portion 208*a* is appropriately referred to as length of the recessed roll portion 208*a* for short. The same is true on the projecting roll portion 208*b*, the recessed roll portion 208*c*, and the projecting roll portion 208*d*.

As illustrated in FIGS. 8 and 9, in the cut position P, the recessed roll portion 208*a* and the projecting roll portion 208*b* are substantially equal in cross-sectional diameter length. That is, the recessed roll portion 208*a* and the projecting roll portion 208*b* are substantially equal in length. Moreover, at an opposed position, the recessed roll portion 208*a* and the projecting roll portion 208*d* are substantially equal in cross-sectional diameter length. That is, the recessed roll portion 208*a* and the projecting roll portion 208*d* are substantially equal in length.

As illustrated in FIGS. 10 and 11, in the cut position Q, the recessed roll portion 208*a* has a cross-sectional diameter length of substantially zero (including completely 0), and thus the recessed roll portion 208*a* has a length of substantially zero. The cross-sectional diameter length of the projecting roll portion 208*b* is substantially equal to a width of the edge 203, and the projecting roll portion 208*b* has a maximum length. Moreover, at an opposed position, the recessed roll portion 208*c* has a length of substantially zero, the cross-sectional diameter length of the projecting roll portion 208*d* is substantially equal to the width of edge 203, and the projecting roll portion 208*d* has the maximum length.

As illustrated in FIGS. 12 and 13, in the cut position R, a cross-sectional diameter length of the recessed roll portion 208*c* is larger than the length of the projecting roll portion 208*b*. That is, the recessed roll portion 208*c* is larger than the projecting roll portion 208*b* in length. Moreover, the cross-sectional diameter length of the recessed roll portion 208*c* is larger than the length of the projecting roll portion 208*d*. That is, the recessed roll portion 208*c* is larger than the projecting roll portion 208*d* in length.

As described above, in the present embodiment, at least part of the edge (e.g., in the vicinity of the center in the longitudinal direction of the edge) continuously has the first changing shape and the second changing shape. For example, the first changing shape and the second changing shape are formed bordering the top portion of the projecting roll portion. Note that the top portion of the projecting roll portion may be formed continuously within a certain range so that the first changing shape and the second changing shape are formed bordering the top portion. That is, the continuous formation of the first changing shape and the second changing shape includes formation of the first changing shape and the second changing shape in an adjacent manner bordering a predetermined shape, in addition to continuous formation of the first changing shape and the second changing shape.

The formation of the changing shape in which the recessed roll portion and the projecting roll portion are changed from one to the other, at least at part of the edge, provides a uniform or substantially uniform force for supporting the diaphragm having the weight. The diaphragm can be readily vibrated uniformly in the positive direction and the negative direction (amplitude linearity is improved), and vibrating operation of the diaphragm can be stabilized.

When a passive radiator has a main body portion of, for example, a track shape, the first changing shape and the second changing shape are preferably formed at a portion in a longitudinal direction of an edge. Thus, although the passive radiator having a main body portion of, for example, a track shape has a low rigidity (bending strength) in the longitudinal direction, the shape in which the recessed roll portion and the projecting roll portion are changed from one to the other in the longitudinal direction increases the rigidity against bending in the longitudinal direction. Thus, unnecessary vibration can be inhibited. As a matter of course, the first changing shape and the second changing shape may be formed in a transverse direction (arcuate portion) of the edge.

Formation of the first changing shape and the second changing shape can bring about the shape in which the edge is formed to be partially protruded. A portion at which the edge is partially protruded, for example, a top portion of a projecting roll is preferably formed at opposed positions in the vicinities of the centers in the longitudinal directions of the edge. Therefore, rolling can be prevented which is caused by the diaphragm vibrated in an oblique direction by weight of the weight. Note that the vicinity of the center represents the center or a portion within a predetermined range from the center, and is appropriately set according to a size of the passive radiator.

As an expected technique (not prior art), formation of the projecting roll portion almost in the longitudinal direction of the edge (e.g., more than half) to increase the rigidity in the longitudinal direction, or sudden change (e.g., steep) of the roll shapes without gradual change of the roll shapes is considered in order to prevent the rolling. However, the rigidity is increased owing to this configuration, but vibration of the diaphragm itself is inhibited, and thus sound quality may be deteriorated. In the present embodiment, for example, formation of the first changing shape and the second changing shape in the longitudinal direction of the edge allows appropriate setting of a size of the projecting roll portion. Since the size of the projecting roll portion is allowed to be set appropriately, the rolling can be prevented without unnecessarily inhibiting the vibration of the diaphragm.

In the present embodiment, the groove portion 205 is formed between the projecting roll portion 208*b* and the side surface of the flat portion 202. Thus, the projecting roll portion 208*b* can have a round cross-section (curved portion), and an amplitude of the diaphragm can be increased. The groove portion 206 is formed between the projecting roll portion 208*d* and the side surface of the flat portion 202. Thus, the projecting roll portion 208*d* can have a round cross-section (curved portion), and an amplitude of the diaphragm can be increased.

Therefore, the general passive radiator only needs to change the shape of the edge inexpensively. Further, performance of the passive radiator can be increased with a productivity equivalent to that of the general passive radiator. Still further, it is not necessary to closely study performance such as a material or an elastic modulus of the main body portion of the passive radiator. Still another further, unexpected different vibration can be inhibited, and a thin product can be achieved.

2. Second Embodiment

Hereinafter, a second embodiment will be described. In the second embodiment, in order to prevent unnecessary vibration (especially, minute vibration), the passive radiator employs a main body portion on which ribs are formed. Note that, in the second embodiment, the same configurations as those of the first embodiment are denoted by the same reference signs, and repetitive description will be omitted.

Figure 14:
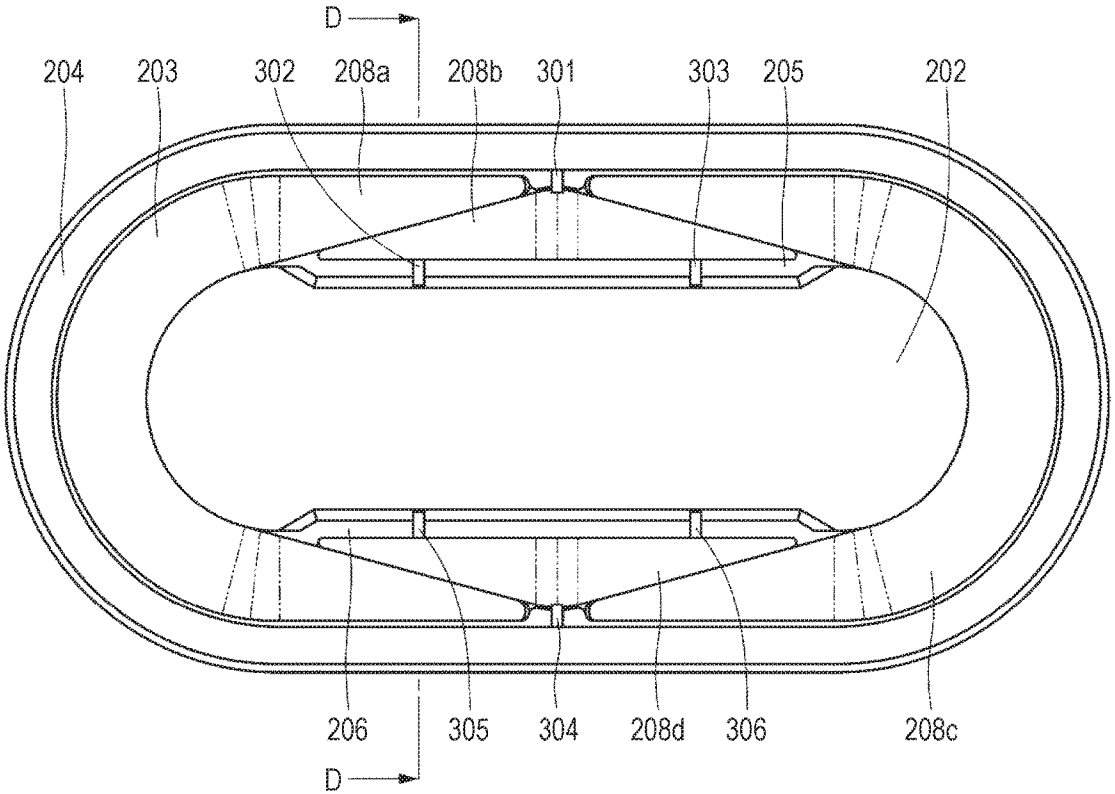
FIG. 14 is a diagram illustrating an exemplary configuration of a main body portion of the passive radiator according to a second embodiment.
Figure 15:
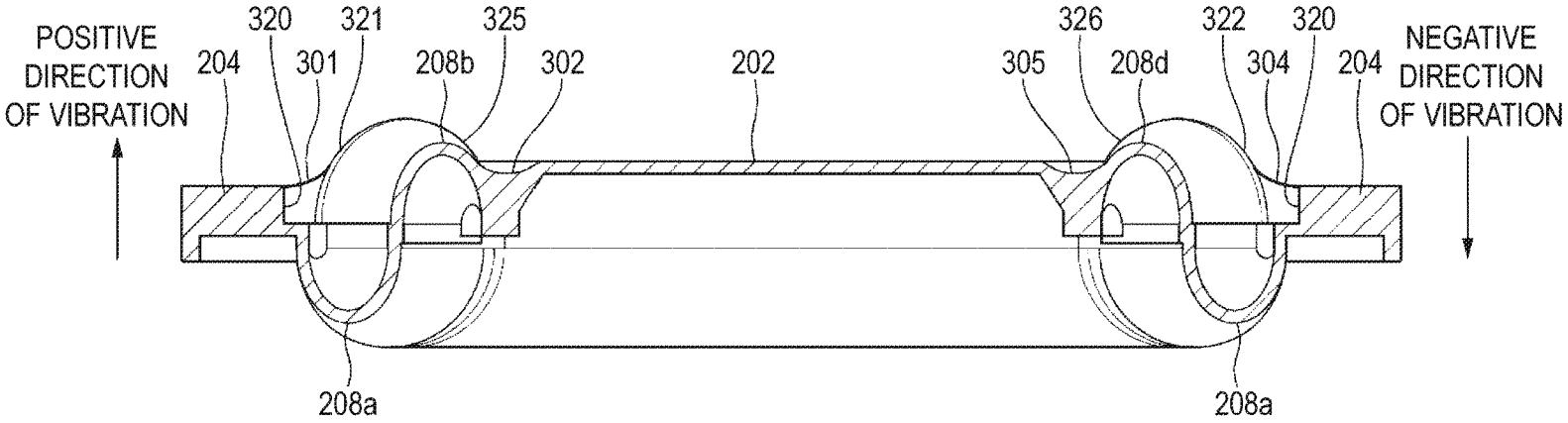
FIG. 15 is a cross-sectional view illustrating a cross-sectional shape taken along the line D-D.
Figure 16:
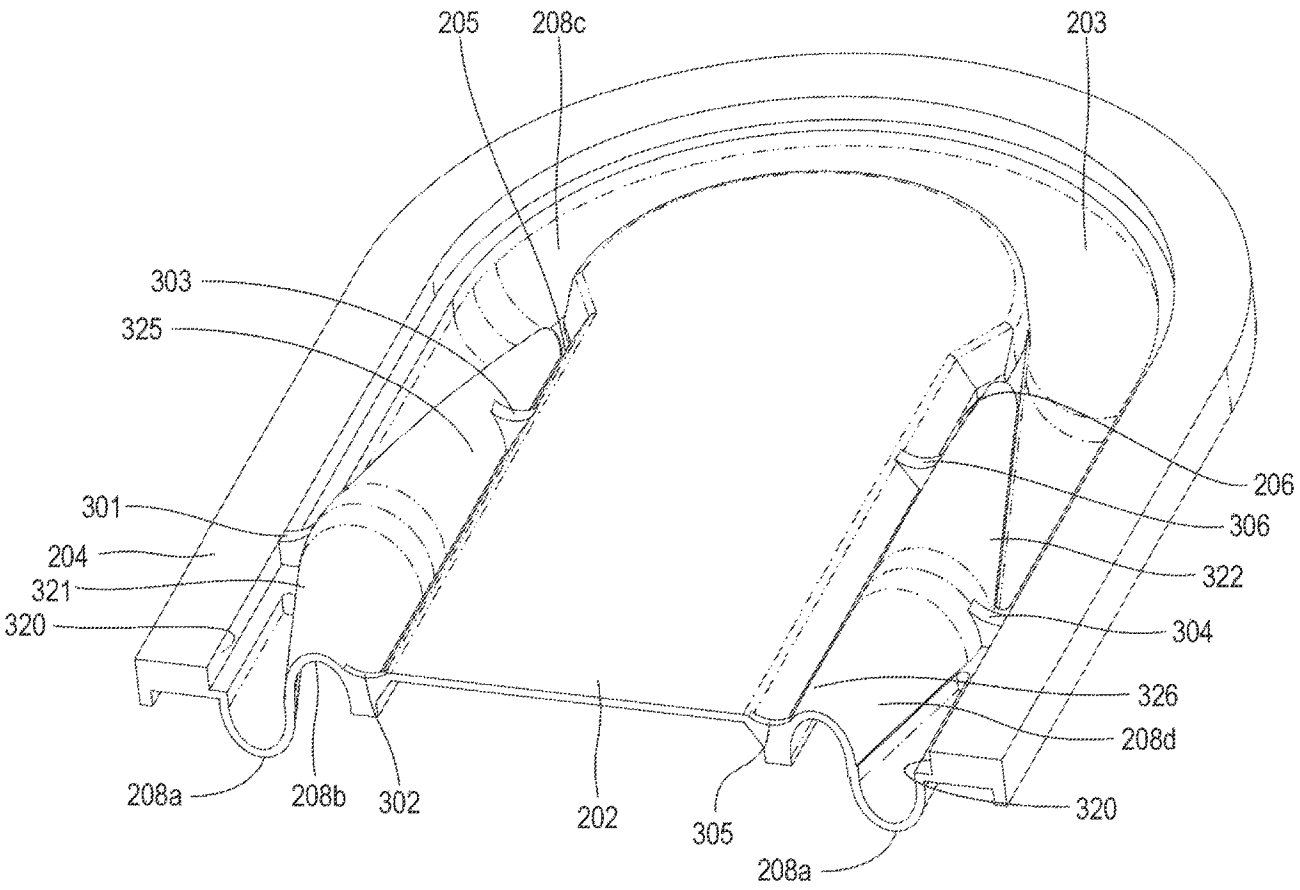
FIG. 16 is a perspective view illustrating a cross-sectional shape taken along the line D-D.

An exemplary configuration of the main body portion of the passive radiator according to the second embodiment is illustrated in FIG. 14. FIGS. 15 and 16 are respectively a cross-sectional view and a perspective view illustrating a cross-sectional shape or the like taken along a cutting plane line D-D passing through a rib 302 and a rib 305 described later.

For example, six ribs (rib 301, rib 302, rib 303, rib 304, rib 305, and rib 306) are formed on the main body portion 300. The ribs are, for example, integrally formed with the main body portion 300, but may be formed separately, for example, to be bonded to the main body portion 300.

The ribs 301, 302, and 303 are formed in one longitudinal direction of the main body portion 300. The ribs 304, 305, and 306 are formed in the other longitudinal direction of the main body portion 300. As illustrated in FIGS. 15 and 16, the rib 301 is formed to abut on an inner wall 320 of the outer peripheral edge portion 204 and an outer peripheral surface 321 of the projecting roll portion 208*b*, for example, in the vicinity of the center in the longitudinal direction. The rib 304 is similarly formed at a position substantially opposed to the rib 301. The rib 304 is formed to abut on the inner wall 320 of the outer peripheral edge portion 204 and an outer peripheral surface 322 of the projecting roll portion 208*d*, for example, in vicinity of the center in the longitudinal direction.

The rib 302 and the rib 303 are formed to cross the groove portion 205. The rib 302 and the rib 303 are formed to abut on an inner peripheral surface 325 of the projecting roll portion 208*b* and the side surface of the flat portion 202. The rib 305 is formed at a position substantially opposed to the rib 302. The rib 306 is formed at a position substantially opposed to the rib 303. The rib 305 and the rib 306 are formed to abut on an inner peripheral surface 326 of the projecting roll portion 208*d* and the side surface of the flat portion 202.

The rib 301 and the rib 304 can support the diaphragm having the weight, and thus, for example, rolling can be prevented which is caused by oblique inclination of the diaphragm due to weight of the weight. Moreover, provision of the ribs can prevent, for example, deformation or vibration in an oblique direction of the passive radiator caused by unnecessary minute vibration, and can prevent or reduce distortion in low-frequency response.

Note that the position at which each rib is formed is not limited to above example. The position at which each rib is formed, the number of the ribs, or the size of each rib may be appropriately changed, as long as the unnecessary vibration is inhibited while maintaining the amplitude of the diaphragm.

Measurements are made of the passive radiator according to the second embodiment and the general passive radiator under the same conditions. In the measurements, identical speaker units and passive radiators of substantially the same size were attached to the cabinets having the same volume, and the behavior of the passive radiator under a constant frequency input was monitored for each frequency.

In the general passive radiator, for example, the passive radiator had a peak of different vibration state at around 70 Hz, causing abnormal sound or distortion of sound. Therefore, the frequency input needed to be reduced at around 70 Hz. Thus, in order to reduce the size or thickness of a product (loudspeaker system) using the passive radiator used for the measurements, frequency input may need to be reduced, since a range of collision of the passive radiator against a surrounding structure is increased due to rotational motion of the passive radiator.

Figure 17:
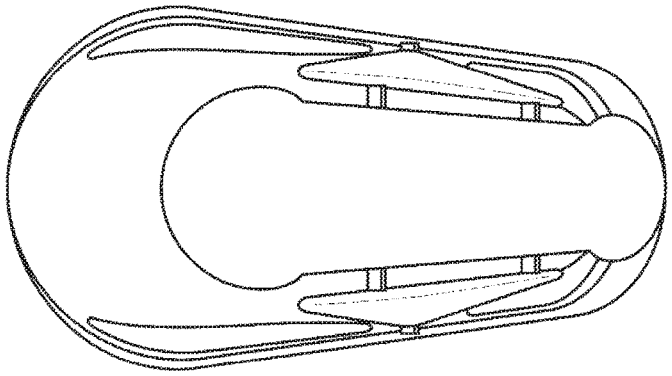
FIGS. 17A, 17B, and 17C are diagrams illustrating exemplary effects according to an embodiment of the present disclosure.
Figure 17:
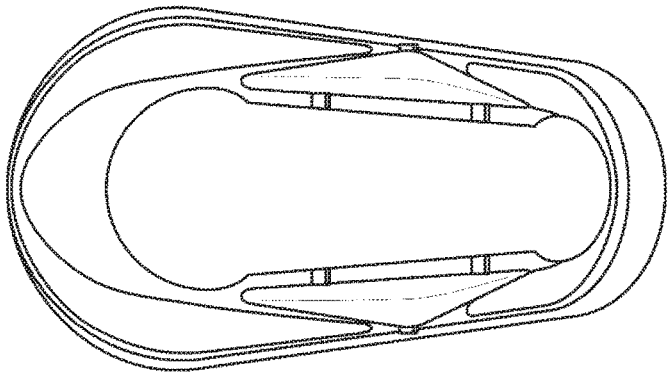
Figure 17:
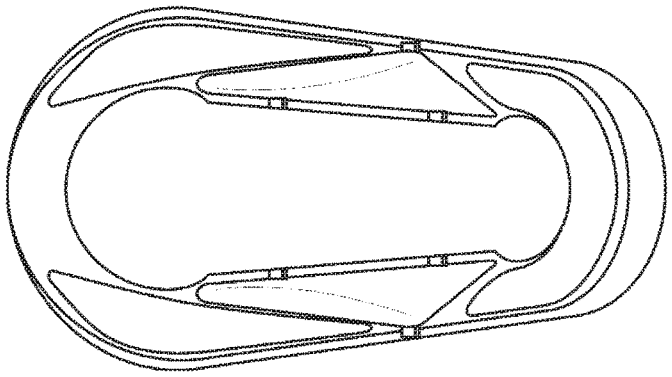

Schematic operation of the passive radiator according to the second embodiment is illustrated in FIGS. 17A to 17C. A state of forward vibration of the passive radiator is illustrated in FIG. 17A, a state of the passive radiator positioned at a neutral position is illustrated in FIG. 17B, and a state of backward (to the inside of the cabinet) vibration of the passive radiator is illustrated in FIG. 17C. As illustrated in FIGS. 17A to 17C, the rotational motion of the passive radiator was not found at any frequency, and generation of the rolling phenomenon can be prevented. Thus, contribution of the passive radiator to improvement in input resistance, prevention of generation of sound distortion, and reduction in size of the product achieved by thickness reduction were confirmed. Note that, although illustration is omitted, similar effects are obtained in the passive radiator according to the first embodiment also has a similar effect.

3. Modifications

The plurality of embodiments of the present disclosure have been described in detail above, but the present disclosure is not limited to the plurality of embodiments described above, and various modifications or alterations can be made within the spirit and scope of the present disclosure.

In the above embodiments, description has been made of the structure in which a pair of the first changing shape and the second changing shape is formed in one longitudinal direction of the edge. However, the structure is not limited to this configuration, and a plurality of the pairs of the first changing shapes and the second changing shapes may be formed in the one longitudinal direction of the edge.

In the above embodiments, description has been made of the edge having substantially the track shape (elliptical shape), but the shape of the edge is not limited to this description. The present disclosure can be applied to an edge having a circular shape, a rectangular shape, or the like. Moreover, the recessed portion and the projecting portion formed in the edge may have a shape different from the roll shape.

In the above embodiments, description has been made of the edge structure of the passive radiator, but the present disclosure can be also applied to an edge structure of a diaphragm of a loudspeaker.

In the above embodiments, the sizes, materials, production processes, and the like are only examples, and they are not limited to these descriptions. For example, the main body portion and the frame of the passive radiator may be made of two color-molded plastic. The diaphragm may include a metal, not plastic, and may be integrally formed with the weight.

Note that the configurations and processing in the embodiments and the modifications can be appropriately combined to each other within a range in which the configurations and processing do not contradict each other. Sequences of the processing in the exemplary processes can be appropriately changed and modified within a range in which the sequences do not contradict each other.

The present disclosure may also include the following configurations.

(1) An edge structure of a diaphragm including an edge surrounding a diaphragm having a recessed portion having a recess in one direction of vibration of the diaphragm, and a projecting portion having a projection in the one direction, at least part of the edge continuously having a first changing shape and a second changing shape, the first changing shape having a shape in which a cross-sectional shape of the recessed portion has a length gradually reduced, a cross-sectional shape of the projecting portion has a length gradually increased, and the recessed portion and the projecting portion change from one to the other, and the second changing shape having a shape in which the cross-sectional shape of the recessed portion having a length gradually increased, the cross-sectional shape of the projecting portion having a length gradually reduced, the projecting portion and the recessed portion change from one to the other.

(2) The edge structure of a diaphragm according to (1), in which the recessed portion and the projecting portion each have a roll shape.

(3) The edge structure of a diaphragm according to (1) or (2), in which the edge has a first side portion and a second side portion opposed to each other, and at least the first side portion has the first changing shape and the second changing shape.

(4) The edge structure of a diaphragm according to (3), in which the first side portion has the first changing shape and the second changing shape, the cross-sectional shape of the projecting portion having a maximum length, in the vicinity of the center of the first side portion.

(5) The edge structure of a diaphragm according to (3) or (4), in which the second side portion has a first changing shape at a position substantially opposed to a position at which the first changing shape is formed, and has a second changing shape at a position substantially opposed to a position at which the second changing shape is formed.

(6) The edge structure of a diaphragm according to any of (1) to (5), in which the edge has substantially a track shape.

(7) The edge structure of a diaphragm according to any of (1) to (6), including a rib abutting on a surface of the projecting portion is provided.

(8) The edge structure of a diaphragm according to (7), in which the rib abuts on the projecting portion and an outer peripheral edge portion of the edge, in the vicinity of a border between the first changing shape and the second changing shape.

(9) The edge structure of a diaphragm according to (7) or (8), including a groove portion between the projecting portion and the vicinity of the center of the main body portion, the rib having a shape formed to cross the groove portion.

REFERENCE SIGNS LIST

1 Loudspeaker system
50, 60 Passive radiator
201 Main body portion
203 Edge
204 Outer peripheral edge portion
208*a*, 208*c* Recessed roll portion
208*b*, 208*d* Projecting roll portion
205, 206 Groove portion
301-306 Rib

The invention claimed is:

1. An edge structure of a diaphragm, comprising:

an edge surrounding the diaphragm, wherein the edge comprises a recessed portion having a recess in a first direction of vibration of the diaphragm, and a projecting portion having a projection in a second direction opposite to the first direction, wherein the edge further comprises a first changing shape of a first side portion and a second changing shape of a second side portion, wherein the first changing shape having a shape in which a cross-sectional shape of the recessed portion has a first length gradually reduced, a cross-sectional shape of the projecting portion has a second length gradually increased, wherein the second changing shape having a shape in which the cross-sectional shape of the recessed portion having a third length gradually increased, the cross-sectional shape of the projecting portion having a fourth length gradually reduced, wherein a first end of the first changing shape with a maximum second length is directly connected to a second end of the second changing shape with a maximum fourth length, to obtain the projecting portion, and wherein the projecting portion comprises a first side connected to the diaphragm through a groove portion.

2. The edge structure of the diaphragm according to claim 1, wherein the recessed portion and the projecting portion each have a roll shape.

3. The edge structure of the diaphragm according to claim 1, wherein the edge has a first side portion and a second side portion opposed to the first side portion, wherein at least the first side portion has the first changing shape and a third changing shape, and wherein at least the second side portion has the second changing shape and a fourth changing shape.

4. The edge structure of the diaphragm according to claim 3, wherein the cross-sectional shape of the projecting portion having a maximum length is in a vicinity of a center of the first side portion.

5. The edge structure of the diaphragm according to claim 3, wherein the second changing shape of the second side portion is at a position opposed to a position of the first changing shape of the first side portion, and the fourth changing shape of the second side portion is at a position opposed to a position of the third changing shape of the first side portion.

6. The edge structure of the diaphragm according to claim 3, wherein the edge has a track shape.

7. The edge structure of the diaphragm according to claim 1, comprising a rib abutting on a surface of the projecting portion.

8. The edge structure of the diaphragm according to claim 7, wherein the rib abuts on the projecting portion and an outer peripheral edge portion of the edge.

9. The edge structure of the diaphragm according to claim 7, wherein the rib has a shape to connect the projecting portion and a side surface of the diaphragm.

10. The edge structure of the diaphragm according to claim 1, wherein a second side of the projecting portion is connected to an inner wall of the edge through a rib.

11. The edge structure of the diaphragm according to claim 1, wherein each of the first changing shape and the second changing shape is connected to the diaphragm through a plurality of ribs.

* * * * *